United States Patent [19]

Wolf

[11] Patent Number: 4,893,460

[45] Date of Patent: Jan. 16, 1990

[54] BELT TYPE SPINDLE DRIVE FOR TEXTILE MACHINES

[75] Inventor: Horst Wolf, Albershausen, Fed. Rep. of Germany

[73] Assignee: Zinser Textilmaschinen GmbH, Fed. Rep. of Germany

[21] Appl. No.: 302,449

[22] Filed: Jan. 26, 1989

[30] Foreign Application Priority Data

Jan. 26, 1988 [DE] Fed. Rep. of Germany ..... 3802200

[51] Int. Cl.[4] ..... D01H 1/241; F16H 7/02

[52] U.S. Cl. ..... 57/105; 57/92; 57/100; 57/104

[58] Field of Search ..... 57/78, 88, 89, 100, 57/104, 105, 92, 93

[56] References Cited

U.S. PATENT DOCUMENTS

| | | | |
|---|---|---|---|
| 3,025,658 | 3/1962 | Steichele et al. | 57/105 |
| 3,035,400 | 5/1962 | Stahlecker | 57/105 |
| 3,753,344 | 8/1973 | Merck | 57/105 |
| 4,103,479 | 8/1978 | Stahlecker et al. | 57/105 |
| 4,265,081 | 5/1981 | Creus | 57/75 |
| 4,612,760 | 9/1986 | Wolf et al. | 57/92 X |
| 4,612,761 | 9/1986 | Wolf | 57/92 X |
| 4,635,431 | 1/1987 | Wolf | 57/100 X |
| 4,730,448 | 3/1988 | Wolf et al. | 57/100 X |
| 4,781,015 | 11/1988 | Dinkelmann et al. | 57/104 X |

FOREIGN PATENT DOCUMENTS

| | | |
|---|---|---|
| 568192 | 1/1933 | Fed. Rep. of Germany . |
| 3500322 | 7/1986 | Fed. Rep. of Germany . |
| 84/02932 | 8/1984 | PCT Int'l Appl. . |

*Primary Examiner*—John Petrakes

*Attorney, Agent, or Firm*—Shefte, Pinckney & Sawyer

[57] ABSTRACT

A belt type spindle drive apparatus for textile machines of the type having a plurality of simultaneously driven aligned spindles arranged in at least one row. An endless belt extends in driving engagement along the spindles and is driven by a plurality of belt driving devices. In one embodiment, the belt driving devices have drive rollers offset from the spindle rows and coaxial overlapping input and output rollers that guide the belt to and from the drive roller between adjacent spindles. The paths of the belt entering and leaving the drive devices are offset. When an uneven number of devices is used, a pair of canted auxiliary rollers are used to make the number of belt path offsets even. To accommodate the offset of the guide rollers, one or the other guide rollers can be canted toward the drive roller or the drive roller can be canted. Alternatively, adjacent drive devices can have the same offset relationship and the belt path can be inclined from one drive device to the other. In another preferred embodiment, the input and output guide rollers are coplanar, but a spindle intermediate the rollers is not contacted by the guided belt. Rather, an additional belt is provided around an additional drive roller mounted on and driven by the input guide roller and a driven roller mounted on the output guide roller, with the additional belt thereby engaging and driving the intermediate spindle.

19 Claims, 4 Drawing Sheets

BELT TYPE SPINDLE DRIVE FOR TEXTILE MACHINES

BACKGROUND OF THE INVENTION

The present invention relates to a machine for producing spun yarn and, more particularly, to such a machine having a plurality of work stations at which yarn is wound on spindles collectively driven by an endless belt.

In one known spindle drive arrangement, one or more rows of spindles are driven by a single endless belt which is itself driven by a plurality of individual drive motors distributed in positions along the length of the belt. An arrangement of this type allows significantly thinner and smaller endless belts to be used, thus leading to considerably more efficient drive transmission, as compared to an arrangement having a single drive motor for driving a larger endless belt.

In one known arrangement for driving an endless belt of a spinning machine, a drive roller is positioned in the vicinity of one of the guide rollers between the spindle rows and around which the endless belt is trained as it passes between the drive roller and an opposed clamping roller (WO 84/02932). However, this arrangement increases the risk of rupture problems.

It is also known to arrange individual drive motors between the rows of spindles and to transfer the drive forces of these motors by means of transmission belts to drive rollers which engage the endless belt (DE-OS 35 00 322). However, this arrangement requires specially designed transmission belts and clamping rollers for the endless belt, and the clamping rollers can cause detrimental compression effects on the belt.

SUMMARY OF THE INVENTION

By the present invention a belt type spindle drive for a textile machine is provided that effectively and reliably maintains drive of spindles.

Briefly described, the belt type spindle drive of the present invention is for a textile machine of the type having a plurality of simultaneously driven aligned spindles arranged in at least one row and driven by an endless belt extending along the spindles in driving engagement therewith. A plurality of belt driving devices are provided, each of which includes a drive roller offset from the aligned spindles and around which the belt is trained for driving the belt. A drive motor drivingly rotates the drive roller. An input guide roller is disposed intermediate the ends of the row of spindles for guiding the belt from driving alignment with a spindle in the row to the drive roller and an output guide roller is disposed intermediate the ends of the row of spindles for guiding the belt from the drive roller into driving engagement with a spindle in the row.

In one preferred embodiment of the present invention, the input roller and output roller of each of the belt driving devices are disposed in overlapping relation and have belt guiding surfaces offset axially from one another whereby the pads of the belt to and from each belt driving device are offset. Preferably, the input roller and output roller of each belt driving device are overlapped in generally coaxial relation and the input guides the belt from spindle alignment between two adjacent spindles and the output roller guides the belt back into spindle alignment between the same two adjacent spindles. The input and output rollers of at least one belt drive device are oppositely offset in relation to the offset of the input and output rollers of an adjacent belt drive device.

In this embodiment the input and output rollers of each belt device are oppositely offset in relation to the offset of the input and output rollers of each adjacent belt drive device and there are an even number of such belt drive devices.

In an alternate embodiment there are an odd number of belt driving devices with a pair of auxiliary rollers for offsetting the path of the endless belt between the output roller of one belt driving device and the input roller of an adjacent belt driving device, with the auxiliary rollers being canted for inclining the path of the belt therebetween.

The spindles may be arranged in two spaced parallel rows, with the belt extending along both rows of spindles and between rows, and with the aforementioned auxiliary rollers disposed in the path of the belt between rows.

In one embodiment of the present invention, the input and output rollers of one belt drive device are offset in the same relation as the offset of the input and output rollers of an adjacent belt drive device for inclination of the path of the belt between the adjacent belt drive devices. In another form of the present invention, one of the input and output rollers of at least one of the belt drive devices is generally coplanar with the drive roller, and the other of the input and output rollers is canted in the direction toward the drive roller to guide the belt at an inclination therebetween. In another form of the present invention, the drive roller of at least one of the belt drive devices is generally in the plane of one of the input and output rollers of the belt drive device and is canted toward the other of the input and output rollers. In yet another form of the present invention, the drive roller of at least one of the belt drive devices is canted transverse to the paths of the belt to and from the drive roller, and the drive roller is disposed with its periphery extending at an inclination from the plane of the input roller at the location where the belt path from the input roller contacts the drive roller to the plane of the output roller at the location where the belt path toward the output roller leaves contact with the drive roller.

In another preferred embodiment of the present invention, the input roller of at least one belt drive device is generally coplanar with the output roller of the sme belt drive device, with the input and output rollers of the drive device guiding the belt without driving contact with a spindle intermediate the input and output rollers. In this embodiment means are provided for driving the intermediate spindle in the form of an input drive roller mounted on and driven simultaneously with and by the input guide roller, an output driven roller mounted for independent rotation on the output guide roller, and an additional endless drive belt extending around the input drive roller and the output driven roller in driving alignment with the intermediate spindle.

Various other and further advantages and features of the present invention will be apparent from the accompanying drawings and the following detailed description.

DETAILED DESCRIPTION OF THE PREFERRED EMBODIMENT

Figure 1:
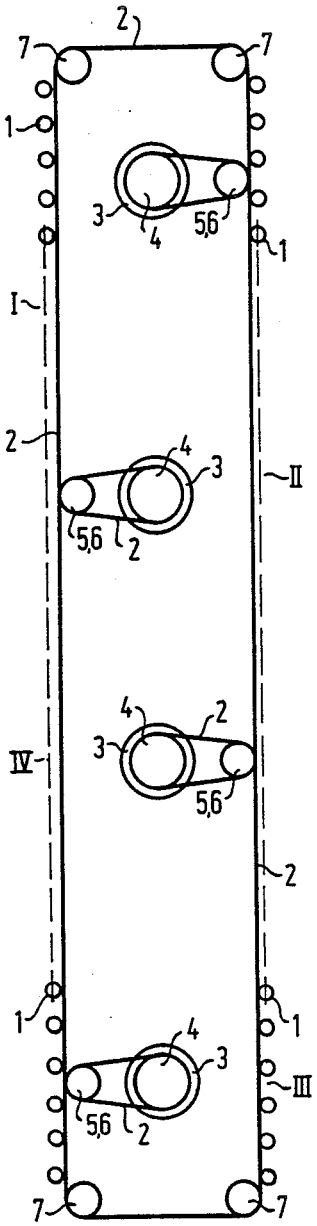
FIG. 1 is a schematic representation of the spindle drive arrangement of a textile spinning machine incorporating one preferred embodiment of the present invention.

In FIG. 1, one preferred embodiment of the spindle drive of the present invention is illustrated in an arrangement for driving a plurality of spindles 1 of a spinning machine. The spindles 1 are arranged in two parallel spaced rows in a plurality of groupings about the periphery of the spinning machine and are all driven by an endless belt 2 extending around the periphery of the machine. The endless belt 2 itself is driven by an even number of belt drive devices of one preferred embodiment of the present invention. In accordance with the present invention, each belt drive device includes a drive roller 4 mounted on a shaft of an electric motor 3 for rotation thereby and spaced from an input guide roller 5 and an output guide roller 6, which guide rollers are arranged in overlapping coaxial relation to one another. The drive roller 4 of each drive device is offset from the adjacent spindle 1 inwardly of the machine.

The endless belt 2 is trained around the guide rollers 5, 6 and the drive roller 4 such that is sequentially travels around the input guide roller 5, around the drive roller 4, and then around the output guide roller 6, and then to the respective adjacent spindle 1. With this arrangement the path of the belt extending to the input guide roller is offset from the path of the belt leaving the output guide roller, with the guide rollers of adjacent drive devices being oppositely offset to accommodate this offset arrangement. This opposite offset roller relation of adjacent drive devices continues around the machine when there are an even number of drive devices, such as the four illustrated in FIG. 1.

Figure 3:
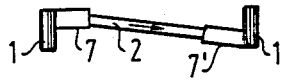
FIG. 3 is a vertical sectional view of the spindle drive arrangement of FIG. 2, taken along line III—III in FIG. 2.
Figure 2:
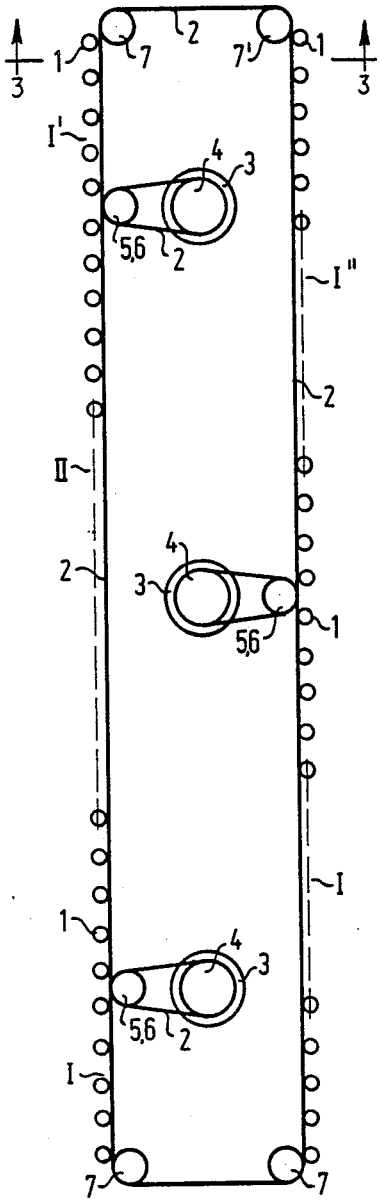
FIG. 2 is a schematic representation similar to FIG. 1 showing a modified form of a preferred embodiment of the present invention.

In FIG. 2, three belt drive devices are illustrated for driving the endless belt 2; in other words, the drive arrangement includes an uneven number of drive devices. In this arrangement, the endless belt 2 can travel, for example, in region II along a lower travel path until raised to a higher level by a drive device at the region I'. Thereafter, the endless belt 2 travels around a pair of auxiliary rollers 7,7' at the end of the two rows of spindles and around which the belt is trained for travel between rows before entering the region I''. The travel of the endless belt 2 between the auxiliary rollers 7,7' is illustrated in FIG. 3, wherein it is seen that the auxiliary rollers 7,7' are canted for inclining the path of the belt therebetween to provide an offset so that the belt will be at the appropriate level for engaging the input guide roller of the following drive device. After traveling through the region I'', the endless belt 2 is raised by a second drive device to a higher travel path and travels along this higher travel path through the region I which includes a second pair of auxiliary rollers 7,7', which are not canted.

In the event of an uneven number of drive devices, such as, for example, the three drive devices in FIG. 2, the endless belt 2 must necessarily travel at an incline in at least one region of its travel path such as, for example, the inclined region between the first pair of auxiliary rollers 7,7' illustrated in FIG. 3.

Figure 4:
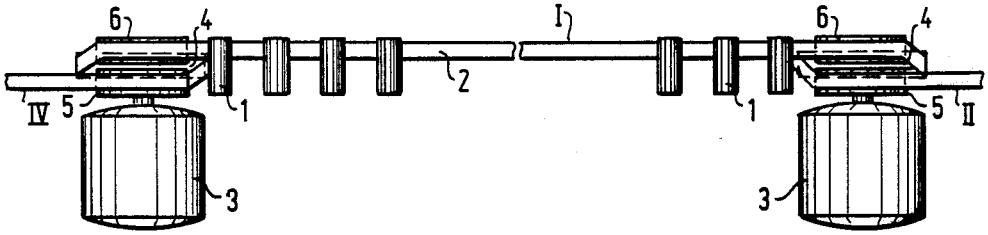
FIG. 4 is a front elevational view of two belt drive devices according to a preferred embodiment of the present invention.
Figure 5:
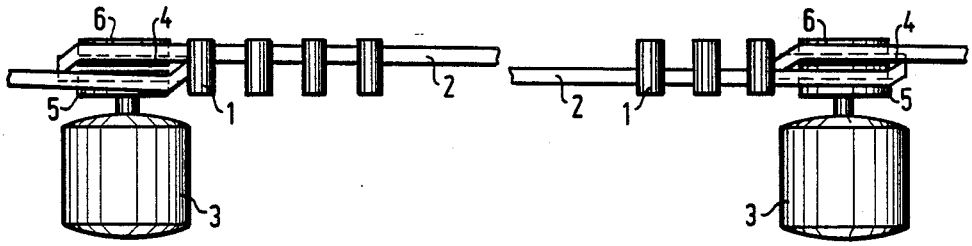
FIG. 5 is a front elevational view of two belt drive devices of a modified form of a preferred embodiment of the present invention.

In FIGS. 4–5, two arrangements for orienting the endless belt 2 between two adjacent drive devices is illustrated. In FIG. 4, one arrangement for use with an even number of drive devices (such as, for example, the arrangement in FIG. 1 of four drive devices) is illustrated. The endless belt 2 travels from the region IV sequentially around the input guide roller 5, the drive roller 4, and the output guide roller 6 of the drive devices. Then, the endless belt 2 travels along the grouping of spindles 1 in the region I, passes around a pair of uncanted auxiliary rollers 7 (FIG. 1) and then engages several spindles 1 of the spindle grouping I in the other spindle row before engaging the input guide roller 6 of a second drive device. Thereafter, the endless belt 2 travels sequentially around the drive roller 4 and the output guide roller 5 of the second drive device before engaging the spindles 1 of the spindle grouping in the region II. As can be appreciated, the endless belt 2 is traveling along a first predetermined level as it exits the region IV and is engaged by the first drive device, and is then raised by the first drive device to a travel path higher than the first predetermined level. Thereafter, the endless belt 2 travels along the higher travel path to the second drive device at which it is subsequently lowered to the first predetermined level for its travel through the region II. In a similar manner, the endless belt 2 is raised to the higher travel path again by a third drive device at the region II and the endless belt 2 then travels through the region III at the higher travel path before thereafter being transferred by a fourth drive device to the first predetermined level for its travel through the region IV and back to the first drive device.

In FIG. 5, an arrangement is illustrated for the travel of the endless belt 2 between a pair of adjacent first and second drive devices, in each of which the plane of the input guide roller 5 is below the plane of rotation of the output guide roller 6. In this arrangement, the endless belt 2 travels around the input guide roller 5 of the first drive device, around its drive roller 4 and then around and from its output guide roller 6. Thereafter, the endless belt 2 travels in a downwardly inclined path to eventually travel to the lower input guide roller 5 of the second drive device. Then, the endless belt 2 travels around the drive roller 4 of the second device and around the upper output guide pulley 6, whereupon it again travels in a downwardly inclined path toward the lower input guide roller 5 of the next adjacent drive device.

Figure 6:
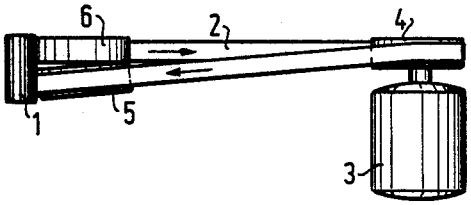
FIG. 6 is a side elevational view of a belt drive device of a preferred embodiment of the present invention.

In FIGS. 6–9, several arrangements for training the endless belt 2 around the guide rollers 5,6 and the drive roller 4 are illustrated. In FIG. 6, the upper output guide roller 6 of a drive apparatus is generally coplanar with the drive roller 4 thereof, and the lower input guide roller 5 is canted toward the drive roller 4 to guide the belt at an inclination therebetween.

Figure 7:
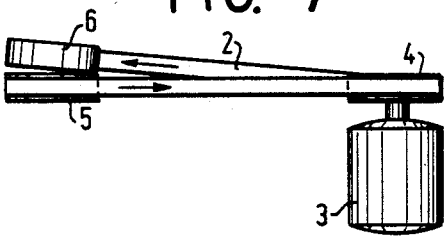
FIG. 7 is a side elevational view of a modification of a belt drive device of a preferred embodiment of the present invention.

In FIG. 7, a drive device is illustrated in which the drive roller 4 is coplanar with the lower guide roller 5 and the upper guide roller 6 is canted with respect to the drive roller 4. To adapt the drive roller 4 to various arrangements such as illustratd in FIGS. 6 and 7, for example, the drive motor 3 can be secured in a movable frame (not shown).

Figure 8:
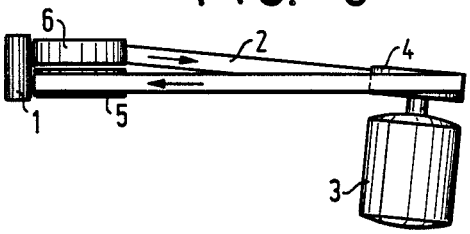
FIG. 8 is a side elevational view of another modification of a belt drive device of a preferred embodiment of the present invention.
Figure 9:
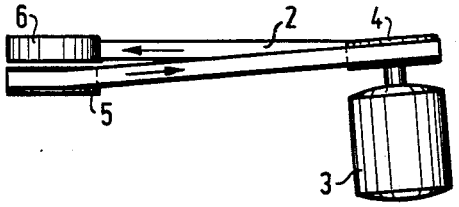
FIG. 9 is a side elevational view of a further modification of a belt drive device of a preferred embodiment.

In FIGS. 8 and 9, the guide rollers 5,6 are coaxial with one another and their axes are parallel and parallel with the axes of the spindles 1. The drive roller 4 along with the electric motor 3 is preferably secured in a movable frame (not shown). In these embodiments, the inclination of the axis of the drive roller 4 as well as the height of the drive roller 4 is variable in response to the direction of travel of the endless belt 2. For example, in FIG. 8, the endless belt 2 trvels from the upper guide roller 6 to the drive roller 4, which is canted toward the upper guide roller 6 and the drive roller 4 is generally in the plane of the lower guide roller 5 such that the belt 2 travels therebetween in a path generally coplanar with the output roller 5.

In FIG. 9, the drive roller 4 is canted with respect to the input guide roller 5 and the height of the drive roller 4 relative to the height of the output guide roller 6 is such that the belt 2 travels therebetween in a path generally coplanar with the output guide roller 6.

Figure 10:
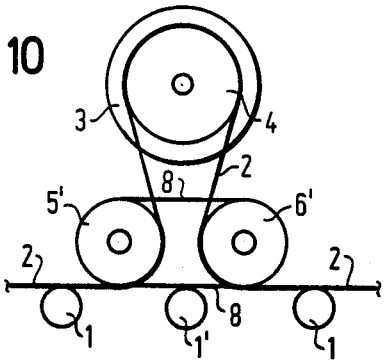
FIG. 10 is a top plan view of another preferred embodiment of the belt drive device of the present invention, showing a separate drive belt for driving an intermediate spindle.
Figure 11:
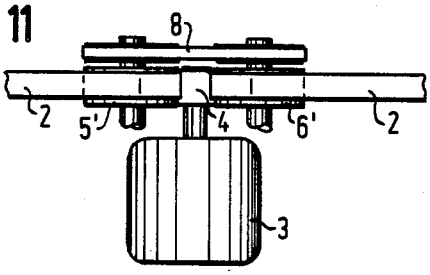
FIG. 11 is a front elevational view of the device shown in FIG. 10.
Figure 12:
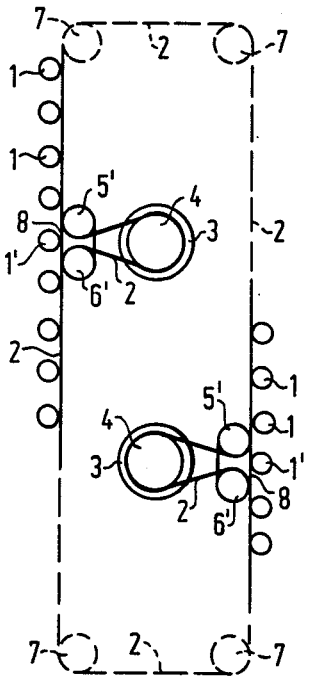
FIG. 12 is a schematic representation of a belt type spindle drive incorporating two belt drive devices of the embodiment illustrated in FIGS. 10 and 11.

The above-described aspects of the drive device of the present invention offer the advantage that a single endless belt can be used to drive all of the spindle or work elements of a machine. As can be appreciated, the travel of the endless belt at various relative heights requires a lengthening of the spindle to accommodate the belt and which makes it difficult to achieve the desirable situation of the endless belt engaging the spindles in the plane of the neck bearing of the spindles. This difficulty can be avoided with another preferred embodiment of the present invention as illustrated in FIGS. 10,11 and 12. In this embodiment, the input guide roller 5′ and the output guide roller 6′ are arranged in side-by-side relation to one another in a common plane and at a spacing from one another such that the endless belt 2 travels sequentially around the input guide roller 5′, the drive roller 4 and the output guide roller 6′. To drive the spindle 1′, an additional endless belt 8 is provided which is trained around an output drive roller mounted coaxially on and drawn simultaneously with and by the input guide roller 5′ and around an output drive roller mounted for independent rotation on the output guide roller 6′. Accordingly, the additional endless belt 8 is driven at a speed corresponding to the speed of rotation of the main endless belt 2. The additional endless belt 8 travels in the plane of the neck bearing of the intermediate spindle 1′, whereby the spindle 1′ is rotatively driven by the additional endless belt 8 during the travel of the main endless belt 2.

In FIG. 12, a pair of drive devices of the type illustrated in FIGS. 10 and 11, are illustrated in use in driving the endless belt 2 along the periphery of a spinning machine.

Figure 13:
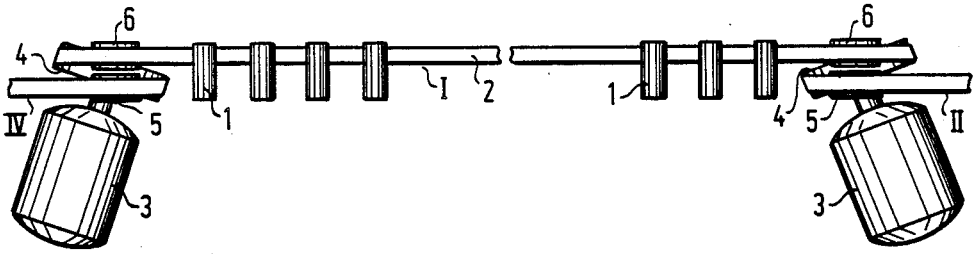
FIG. 13 is a front elevational view of two belt drive devices according to another preferred embodiment of the present invention.

In FIG. 13, another preferred embodiment of the present invention is illustrated In this embodiment a pair of drive devices are spaced from each other and the axes of their drive rollers 4 are canted transverse to the paths of the belt to and from the drive rollers 4, with the drive rollers being disposed with their peripheries extending at an inclination from the planes of the input rollers at the locations where the belt paths from the input rollers contact the drive rollers to the planes of the output rollers at the locations where the belt paths toward the output rollers leave contact with the drive rollers. Specifically, with regard to the left-hand drive apparatus shown in FIG. 13, the drive roller thereof is oriented at an angle to the two travel paths of the endless belt 2 along the region IV and I, respectively. The drive roller 4 is canted with respect to the rollers 5,6 such that the endless belt traveling from the region IV first encounters the pulley at a lower level and exits the roller at the higher travel path of the region I Similarly, the right-hand drive apparatus shown in FIG. 13 has its drive roller 4 angled with respect to the travel path of the endless belt 2 and canted with respect to the rollers 5,6 such that the endless belt 2 first encounters the drive roller 4 after traveling around the upper guide roller 6 and exits the drive roller 4 to travel around the lower guide roller 5 and then along the lower travel path of the region II.

The apparatus of the present invention allows a considerable savings of space to be realized. If desired, the endless belt used in connection with the apparatus of the present invention can be provided with a belt tensioning apparatus of known type.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A belt type spindle drive apparatus for textile machines of the type having a plurality of simultaneously driven aligned spindles arranged in at least one row, comprising:

an endless belt extending along said spindles in driving engagement therewith;

a plurality of belt driving devices, each belt driving device including a drive roller offset from said aligned spindles and around which said belt is trained for driving said belt, a drive motor for drivingly rotating said drive roller, an input guide roller intermediate the ends of said row of spindles for guiding said belt from driving alignment with a spindle in said row to said drive roller, and an output guide roller intermediate the ends of said row of spindles for guiding said belt from said drive roller into driving engagement with a spindle in said row.

2. A belt type spindle drive apparatus according to claim 1 and characterized further in that said input roller and said output roller of each of said belt driving devices are disposed in overlapping relation and have belt guiding surfaces offset axially from one another whereby the paths of the belt to and from each belt driving device are offset.

3. A belt type spindle drive apparatus according to claim 2 and characterized further in that said input roller and said output roller of each belt driving device are overlapped in generally coaxial relation.

4. A belt type spindle drive apparatus according to claim 1, 2 or 3 and characterized further in that said input roller guides the belt from spindle alignment between two adjacent spindles and said output roller guides said belt back into spindle alignment between the same two adjacent spindles.

5. A belt type spindle drive apparatus according to claim 2 and characterized further in that said input roller and said output roller rotate independently of one another.

6. A belt type spindle drive apparatus according to claim 2 and characterized further in that the input and output rollers of at least one belt drive device are oppositely offset in relation to the offset of the input and output rollers of an adjacent belt drive device.

7. A belt type spindle drive apparatus according to claim 2 and characterized further in that the input and output rollers of each belt drive device are oppositely offset in relation to the offset of the input and output rollers of each adjacent belt drive device.

8. A belt type spindle drive apparatus acording to claim 7 and characterized further in that there are an even number of belt drive devices.

9. A belt type spindle drive apparatus according to claim 7 and characterized further in that there are an odd number of said belt driving devices, and by a pair of auxiliary rollers for offsetting the path of said endless belt between the output roller of one belt driving device and the input roller of an adjacent belt driving device.

10. A belt type spindle drive apparatus according to claim 9 and characterized further in that said auxiliary rollers are canted for inclining the path of the belt therebetween.

11. A belt type spindle drive apparatus according to claim 9 or 10 and characterized further in that said spindles are arranged in two spaced parallel rows, said belt extends along both rows of spindles and between rows, and said auxiliary rollers are disposed in the paths of said belt between said rows.

12. A belt type spindle drive apparatus according to claim 2 and characterized further in that the input and output rollers of one belt drive device are offset in the same relation as the offset of the input and output rollers of an adjacent belt drive device for inclination of the path of the belt between said adjacent belt drive devices.

13. A belt type spindle drive apparatus according to claim 2 and characterized further in that one of said input and output rollers of at least one of said belt drive devices is generally coplanar with said drive roller and the other of said input and output rollers is canted in the direction toward said drive roller to guide said belt at an inclination therebetween.

14. A belt type spindle drive apparatus according to claim 2 and characterized further in that the drive roller of at least one of said belt drive devices is generally in the plane of one of said input and output rollers of said belt drive device and is canted toward the other of said input and output rollers.

15. A belt type spindle drive apparatus according to claim 2 and characaterized further in that said drive roller of at least one of said belt drive devices is canted transverse to the paths of the belt to and from said drive roller.

16. A belt type spindle drive apparatus according to claim 15 and characterized further in that said canted drive roller is disposed with its periphery extending at an inclination from the plane of the input roller at the location where the belt path from the input roller contacts the drive roller to the plane of the output roller at the location where the belt path toward the output roller leaves contact with the drive roller.

17. A belt type spindle drive apparatus according to claim 1 and characterized further in that said roller of at least one belt drive device is generally coplanar with said output roller of said at least one belt drive device.

18. A belt type spindle drive apparatus according to claim 17 and characterized further in that said input and output rollers of said at least one drive device guide said belt with driving contact with a spindle intermediate said input and output rollers, and by means for driving said intermediate spindle.

19. A belt type spindle drive apparatus according to claim 18 and characterized further in that said intermediate drive means comprises an input drive roller mounted on and driven simultaneously with and by said input guide roller, an output driven roller, mounted for independent rotation on said output guide roller, and an additional endless drive belt extending around said input drive roller and said output driven roller in driving alignment with said intermediate spindle.

* * * * *